US007131934B2

(12) United States Patent
Dadbeh

(10) Patent No.: US 7,131,934 B2
(45) Date of Patent: Nov. 7, 2006

(54) IMPACT ABSORBING EXERCISE PLATFORM

(75) Inventor: Bemanali H. Dadbeh, Encinitas, CA (US)

(73) Assignee: Sop Services, Inc., Las Vegas, NV (US)

( * ) Notice: Subject to any disclaimer, the term of this patent is extended or adjusted under 35 U.S.C. 154(b) by 0 days.

(21) Appl. No.: 10/703,926

(22) Filed: Nov. 7, 2003

(65) Prior Publication Data

US 2005/0101444 A1 May 12, 2005

(51) Int. Cl.
*A63B 22/04* (2006.01)
*A63B 21/02* (2006.01)

(52) U.S. Cl. ..... 482/52; 482/123

(58) Field of Classification Search ..... 482/51, 482/52, 121, 123, 129, 130, 142, 148, 146, 482/147; 446/325, 396; 441/74, 79; 267/141
See application file for complete search history.

(56) References Cited

U.S. PATENT DOCUMENTS 1,509,750 A * 9/1924 Campbell ..... 482/26
3,275,131 A * 9/1966 Erickson ..... 206/523
3,806,116 A * 4/1974 Malmberg et al. ..... 482/147
4,352,491 A * 10/1982 Bellia ..... 482/142
4,880,214 A * 11/1989 Sukai ..... 267/136
5,154,678 A * 10/1992 Adamczyk et al. ..... 482/52
5,330,165 A * 7/1994 van Goubergen ..... 267/141
5,421,800 A * 6/1995 Mullen ..... 482/121
5,441,466 A 8/1995 Piaget et al.
5,472,390 A 12/1995 Faye
5,851,166 A * 12/1998 Bernardson ..... 482/79
5,853,352 A * 12/1998 Login ..... 482/26
6,705,975 B1 * 3/2004 Kuo ..... 482/79
2004/0224824 A1 * 11/2004 Lickle ..... 482/51

OTHER PUBLICATIONS

Lickle, Brett, Balance Training Device and Method of Use, Nov. 11, 2004, Figure 9.*

* cited by examiner

*Primary Examiner*—Jerome Donnelly
*Assistant Examiner*—Tam Nguyen
(74) *Attorney, Agent, or Firm*—Woodard, Emhardt, Moriart, McNett & Henry LLP

(57) ABSTRACT

In a basic configuration, the present system includes an adjustable top portion or platform, one or more lower portions or risers and one or more resilient members placed between the riser and the platform. Preferably the resilient members have a sufficient height to space the platform slightly above the riser, and the resilient members are partially compressible to absorb the impact when a user steps atop the platform. In preferred embodiments, the platform and/or riser include a variety of locations in which the resilient member or members may be placed or arranged to provide various levels of cushioning and/or balancing of the platform over the riser. Preferably the multi-exercise system can be used as a standard horizontal platform, as an angled platform, as a balancing platform, or a resilient member-mounting riser for aerobic exercises, stretching, yoga, balancing or exercises exercising the sole or arch of a foot.

13 Claims, 14 Drawing Sheets

IMPACT ABSORBING EXERCISE PLATFORM

FIELD OF THE INVENTION

This invention relates generally to multi-exercise platforms, and more particularly to a system and method usable in various configurations, for example for reducing the impact shock to users of an exercise platform, for aerobic exercise and for balance exercises.

BACKGROUND OF THE INVENTION

Aerobic exercise platform devices, such as The STEP® are often used in physical fitness regimens to assist in aerobic workouts and simulating climbing or stair activities. One example of these is shown in U.S. Pat. No. 5,158,512. These platforms are typically horizontal or sometimes sloped, elongate, rectangular shapes having a height simulating a stair step. When a higher step is desired for a more difficult routine, one or more risers can typically be placed under the platform to raise the total height of the platform. A typical platform includes a tread or traction area on the top and a stable base to minimize the risk of a person slipping. Most of these products are made from hard materials such as plastic or wood without resiliency. Thus, when a user's foot impacts the top of the step, the force of impact is transmitted to the user's body and particularly the ankles, knees and joints.

An improved exercise system is desired.

SUMMARY OF THE INVENTION

In one basic configuration, the present system includes an adjustable top portion or platform, one or more lower portions or risers and one or more resilient members placed between the riser and the platform. Preferably the resilient members have a sufficient height to space the platform slightly above the riser, and the resilient members are partially compressible to absorb the impact when a user steps atop the platform. In preferred embodiments, the platform and/or riser include a variety of locations in which the resilient member or members may be placed or arranged to provide various levels of cushioning and/or balancing of the platform over the riser. Preferably the multi-exercise system can be used as a standard horizontal platform, as an angled platform, as a balancing platform, or a resilient member-mounting riser for aerobic exercises, stretching, yoga, balancing or exercises exercising the sole or arch of a foot.

In one preferred embodiment, the present invention includes an exercise platform system, including a platform having a top surface for a user to step upon and a lower surface, a riser having an upper surface opposing the lower surface of the platform and at least one piece of resilient material disposed between the lower surface of the platform and the upper surface of the riser. The resilient material spaces the platform apart from the riser. In a preferred embodiment, the resilient material is at least one resilient member.

In a preferred feature, the lower surface of the platform defines at least one recess for receiving at least a portion of at least one resilient member separately.

In a preferred feature, the upper surface of the riser defines at least one recess for receiving at least a portion of at least one resilient member.

In an alternate preferred embodiment, the present invention includes an exercise platform system having a platform with a top surface for a user to step upon and a lower surface and, a riser having an upper surface opposing the lower surface of the platform. Preferably the lower surface of the platform and the upper surface of the riser define at least one location for a resilient member to be placed between them. In another preferred feature, the lower surface of the platform and the upper surface of the riser each define a plurality of locations for one or more resilient members to be placed between them. Preferably the locations are opposing recesses in the platform and the riser.

The present invention further includes an exercise platform having a top surface for a user to step upon and a lower surface, at least one resilient member disposed between the lower surface of the platform and a support surface and spacing the platform above the support surface. Preferably the lower surface of the platform defines at least one recess for receiving at least a portion of one resilient member.

In a still further embodiment, the present invention further includes an exercise system comprising a riser having an upper surface, a plurality of recesses defined in the upper surface and at least one resilient member disposed in one of the recesses It is an object of the invention to provide an improved exercise system.

Further objects, features and advantages of the present invention shall become apparent from the detailed drawings and descriptions provided herein.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

In a basic configuration, the present system includes an adjustable top portion or platform, one or more lower portions or risers and one or more resilient members placed between the riser and the platform. Preferably the resilient members have a sufficient height to space the platform slightly above the riser, and the resilient members are partially compressible to absorb the impact when a user steps atop the platform. In preferred embodiments, the platform and/or riser include a variety of locations in which the resilient member or members may be placed or arranged to provide various levels of cushioning and/or balancing of the platform over the riser. Preferably the multi-exercise system can be used as a standard horizontal platform, as an angled platform, as a balancing platform, or a resilient member-mounting riser for aerobic exercises, stretching, yoga, balancing or exercises exercising the sole or arch of a foot.

Figure 1:
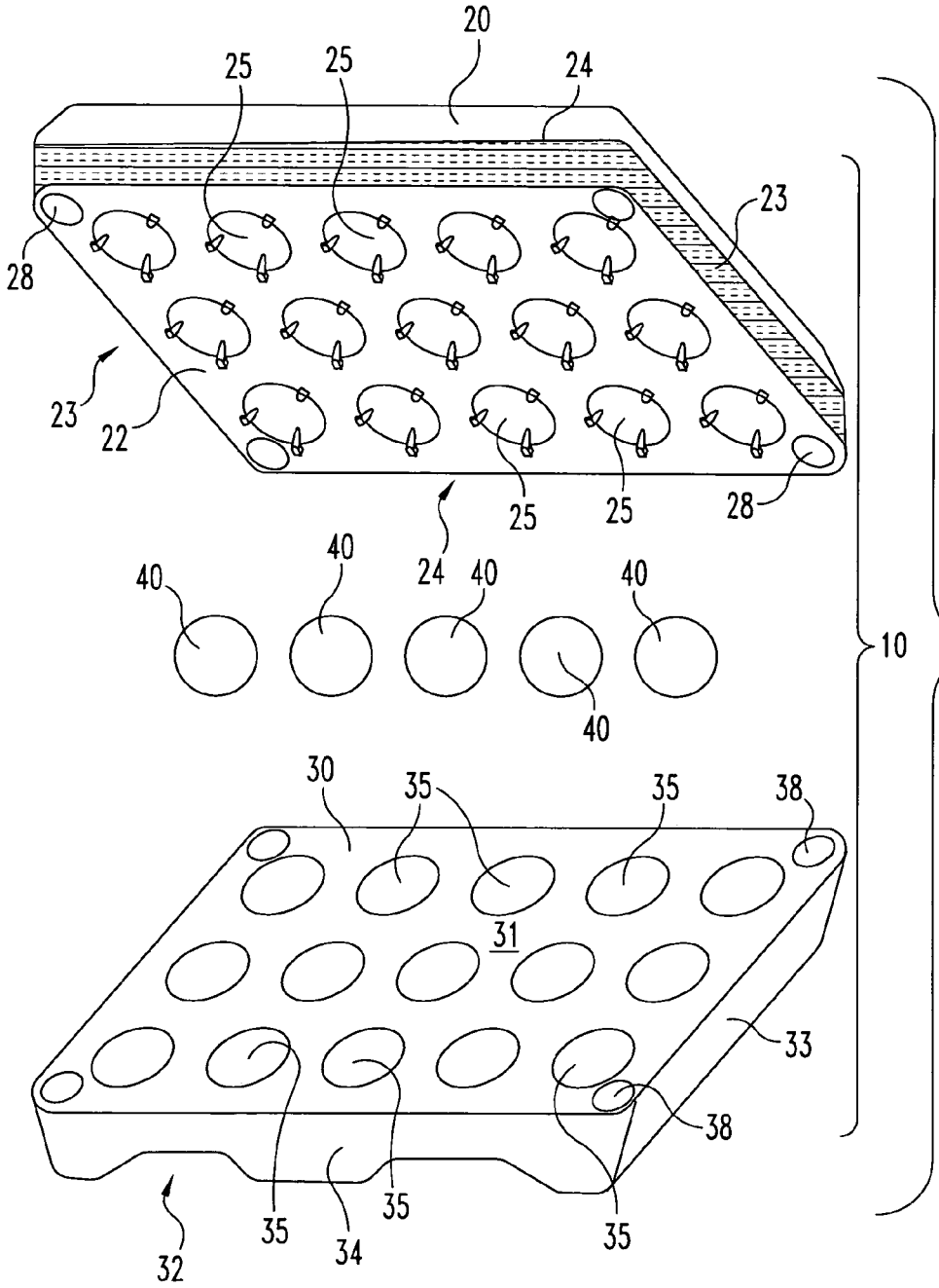
FIG. 1 is an exploded view of one preferred embodiment of the present invention.

An exploded view of an exercise assembly according to one preferred embodiment of the present invention is illustrated in FIG. 1. The multi-exercise system 10 includes platform 20, riser 30 and one or more resilient members 40. As illustrated, platform 20 has a rectangular cross-section with a top or tread surface 21 (FIG. 2C), a lower surface 22 and generally vertical and parallel sidewalls 23 with generally vertical and parallel front and back walls 24 separating the height of top surface 21 from lower surface 22. Alternate geometric shapes can be used as desired. In the embodiment illustrated, lower surface 22 includes a number of recesses 25 for receiving and preferably partially retaining portions of resilient members 40. Recesses 25 in lower surface 22 in one embodiment are substantially all or a portion of a hemispherical shape to receive portions of spherical resilient members 40 and may include retaining tabs. In one preferred embodiment, platform 20 includes alignment portions or lugs, such as pads or feet 28, to support platform 20 on a support surface or riser 30, and to provide friction to prevent slippage between platform 20 and the support surface riser. Feet 28 are preferably adhesively mounted rubber or integrated plastic.

Riser 30 as illustrated is preferably rectangular in shape and preferably of substantially the same rectangular cross-sectional size of platform 20. Riser 30 includes a top surface 31, a lower surface 32 to engage a support surface (such as a floor) and generally vertical sidewalls 33 and front and back walls 34 providing a height between upper surface 31 and lower surface 32. Upper surface 31 is preferably arrangeable to be opposing lower surface 22 of platform 20, and is preferably substantially the same size area for stacking. Upper surface 31 preferably includes one or more recesses 35 for receiving portions of resilient members 40. Preferably recesses 35 are substantially all or portions of a hemisphere to receive all or portions of spherical resilient members 40. In one embodiment, recesses 35 on riser 30 are arranged in a pattern substantially similar to the recesses 25 on platform 20. Example heights for platform 20 are 2" or 4".

Riser 30 may optionally include alignment spots, such as depressions 38, for receiving pads or feet 28 of platform 20, and riser 30 may include similar feet located on lower surface 32. The registration of pads or feet 28 in depressions 38 aid in stability and minimize the risk of slippage. Preferably lower surface 32 is symmetric to upper surface 31, so that one or more risers may be stacked for use or storage as desired. Example heights of risers 30 are 2" and 4".

Resilient members 40 are illustrated in FIG. 1 as spherical balls. The resilient members may be made of rubber, plastic, foam or a cellular material, or similar materials which are partially compressible upon impact to absorb force, and to then re-expand. Spherical balls are illustrated as one preferred shape; however, various geometries can be selected as desired. Resilient members 40 may be substantially solid, hollow or in some cases filled with resilient stuffing or a shock absorbing (i.e., compressible) liquid. The resilient members may be of a substantially permanent shape or inflatable as desired. The resilient members may have a constant compression resistance, or an increasing resistance as the amount of compression rises.

Preferably the resilient members 40 are sized to have a portion partially received in recesses 25 with another portion received in recesses 35, while the resilient member or members have sufficient height to space opposing surfaces 31 and 22 apart from each other in the area where the resilient member is located. Resilient members 40 may be sufficiently compressible that lower surface 22 moves adjacent or contacts upper surface 31 when a user applies downward force to the upper surface 21 of platform 20.

Figure 2A:
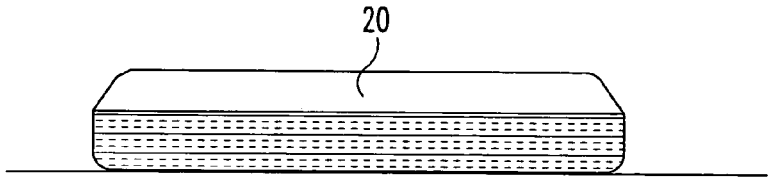
FIGS. 2A–2C illustrate a platform section, a platform section with riser section and the top of a platform section according to a preferred embodiment of the present invention.
Figure 2B:
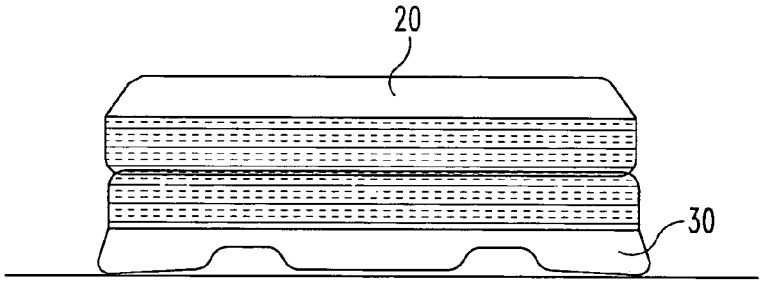
Figure 2C:
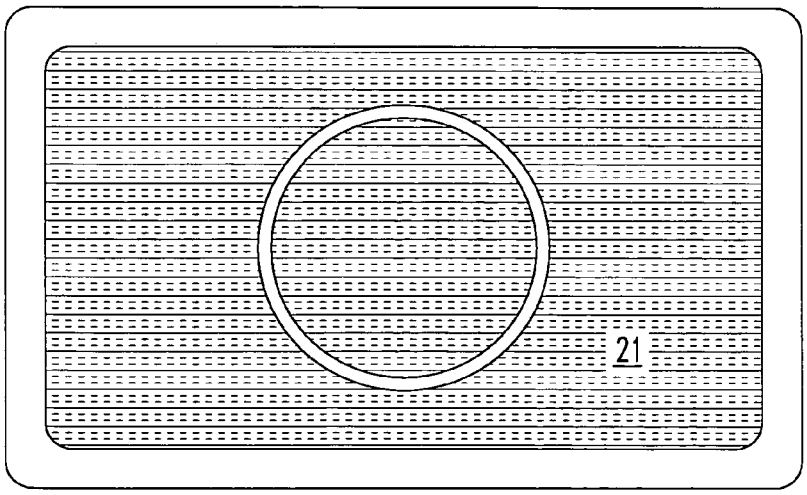

Illustrated in FIGS. 2A–2C is one arrangement of the system 10, similar to a traditional platform, including a platform 20 and riser 30. Platform 20 may be used on a support surface by itself or may be used atop one or more risers 30 to raise the height of platform 20. Preferably in this arrangement feet 28 align and interlock with recesses 38. Platform 20 includes an upper surface 21 which may include a tread or traction area upon which a user may step when using the platform system. This arrangement may be used for traditional stair step exercises.

Figure 3A:
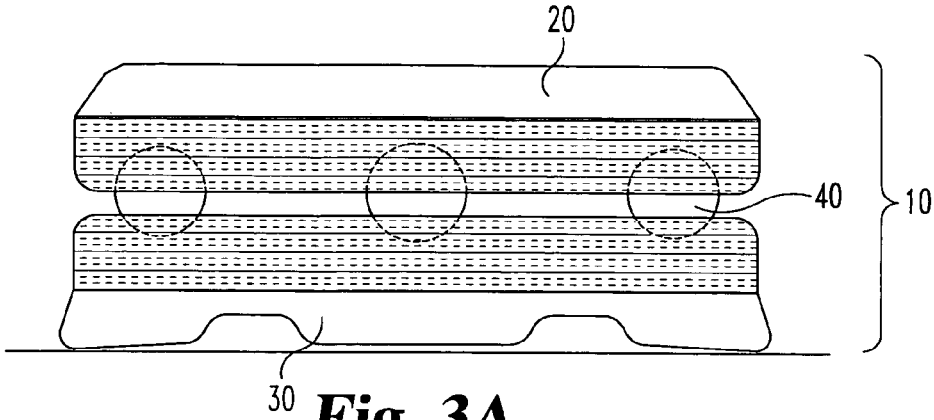
FIGS. 3A–3C illustrate one arrangement of a platform, riser section and an arrangement of resilient members according to one preferred embodiment of the present invention.
Figure 3B:
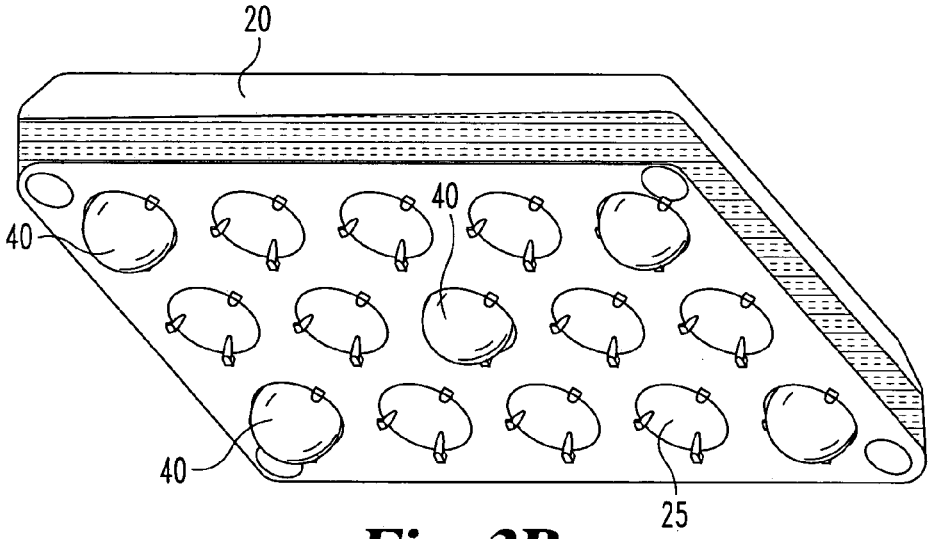
Figure 3C:
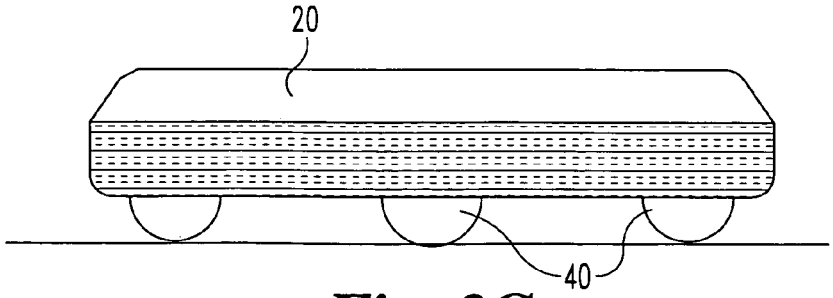

FIGS. 3A–3C illustrate one preferred arrangement of system 10 including platform 20, riser 30 and resilient members 40. Portions of resilient members 40, within the platform and riser are shown with dotted lines for illustration. In this arrangement, resilient members 40 may be placed in the recesses in a substantially "X" pattern to provide a stable horizontal surface for platform 20 over riser 30 or a support surface such as a floor. As examples, this arrangement may be used for traditional stair step exercises or balancing.

Figure 4A:
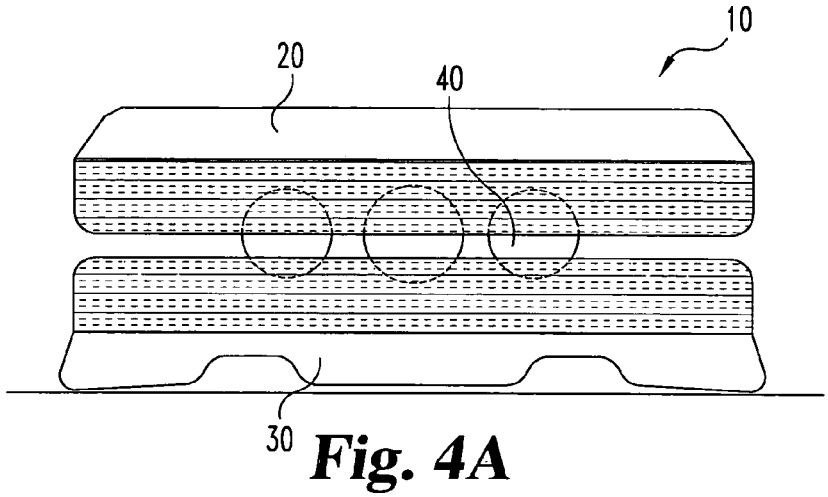
FIGS. 4A–4C illustrate an alternate arrangement of a platform, riser section and an arrangement of resilient members according to one preferred embodiment of the present invention.
Figure 4B:
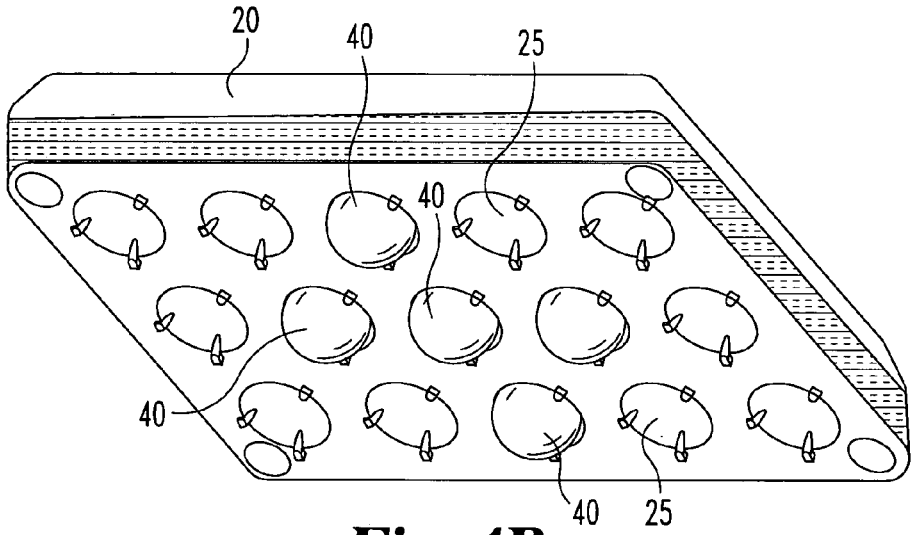
Figure 4C:
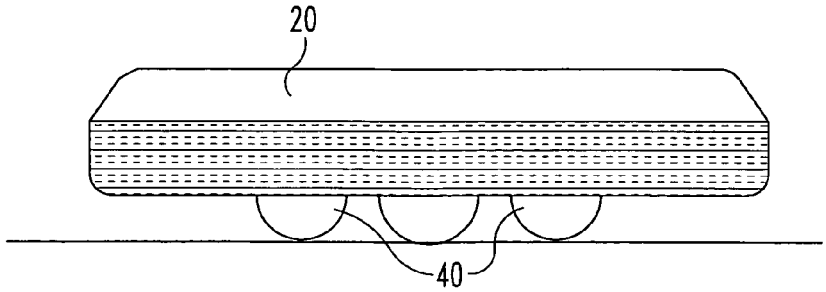

FIGS. 4A–4C illustrate an alternate embodiment of system 10 with resilient members 40 arranged in a "plus" shape centered in the middle of riser 20. In this arrangement, platform 20 is substantially stable in the middle section, but the platform may tilt relative to the riser or a floor if the platform is stepped upon off center. As one example, this arrangement assists in balancing exercises.

Figure 5A:
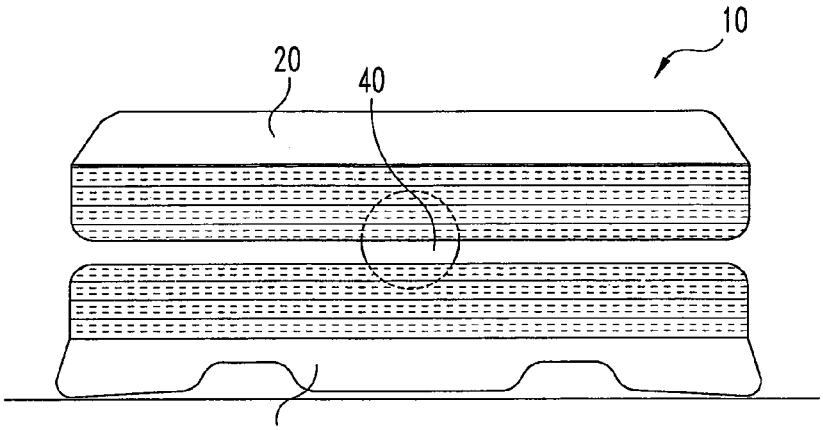
FIGS. 5A–5C illustrate a further alternate arrangement of a platform, riser section and an arrangement of resilient members according to one preferred embodiment of the present invention.
Figure 5B:
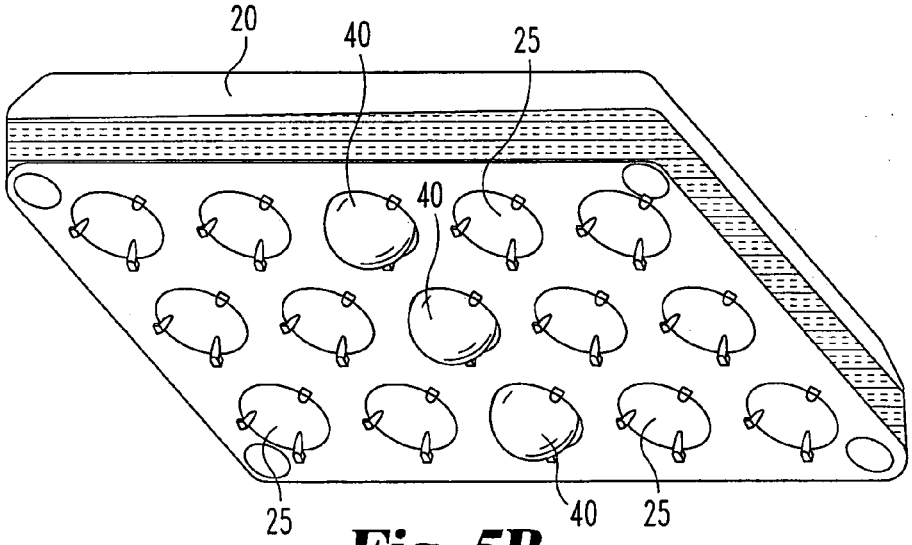
Figure 5C:
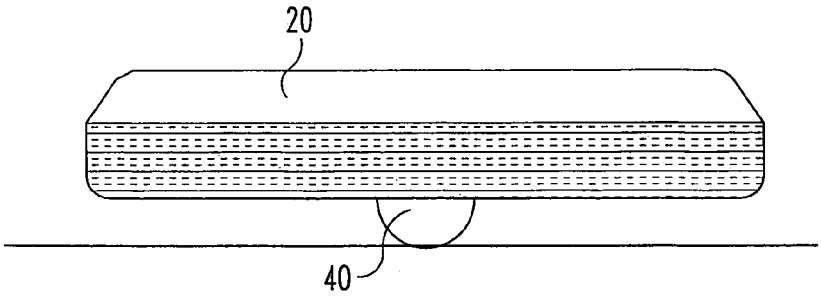

FIGS. 5A–5C illustrate a further alternate arrangement of system 10 including resilient members 40 in a centered line to provide platform 20 a balancing or a see-saw motion when a user steps to one side or the other of the platform. If resilient members 40 are placed in the middle or to one side, a slanted top surface of the platform may also be presented.

Figure 6A:
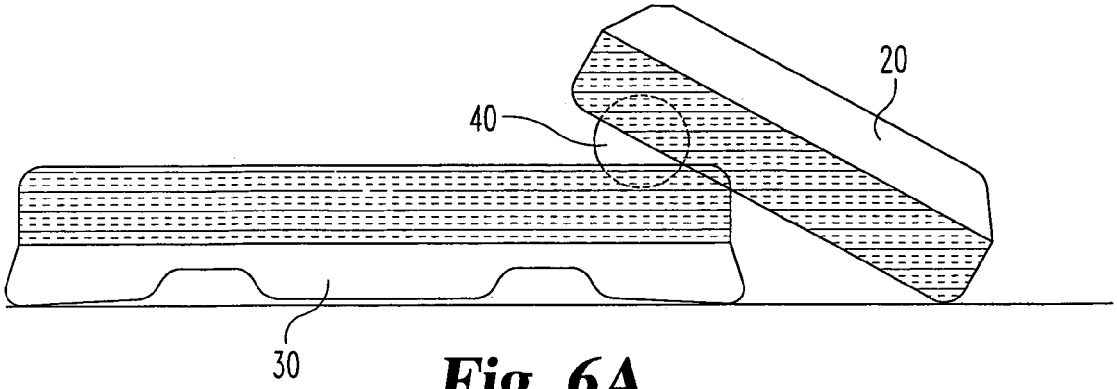
FIGS. 6A–6C illustrate a further alternate arrangement of a platform, riser section and an arrangement of resilient members according to one preferred embodiment of the present invention.
Figure 6B:
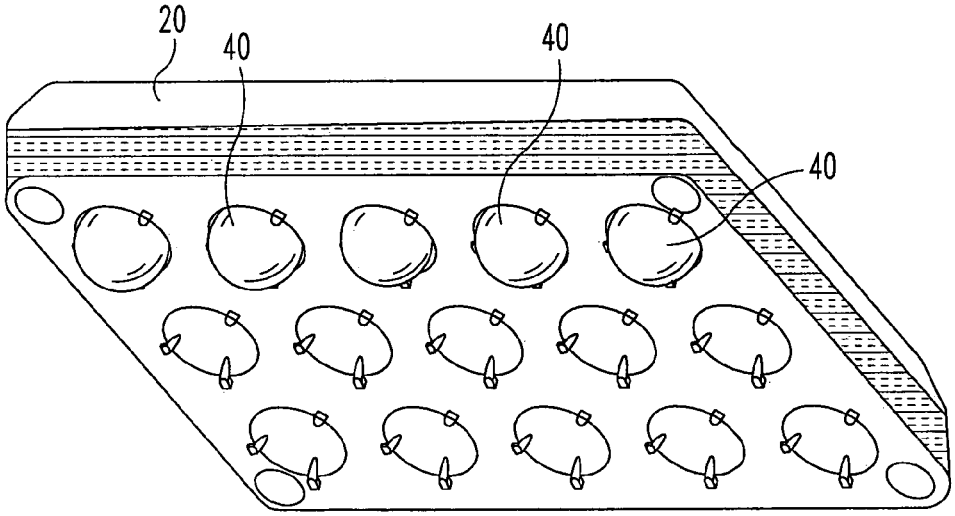
Figure 6C:
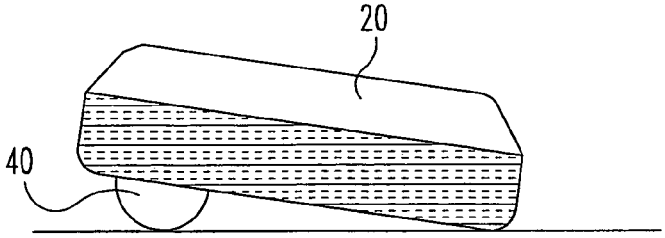

FIGS. 6A–6C illustrate a still further arrangement of resilient members 40 and system 10. In the arrangement, resilient members 40 may be placed along one side of the lower surface of the platform 20 to provide a slanted surface on a floor or based on a riser 30.

Figure 7A:
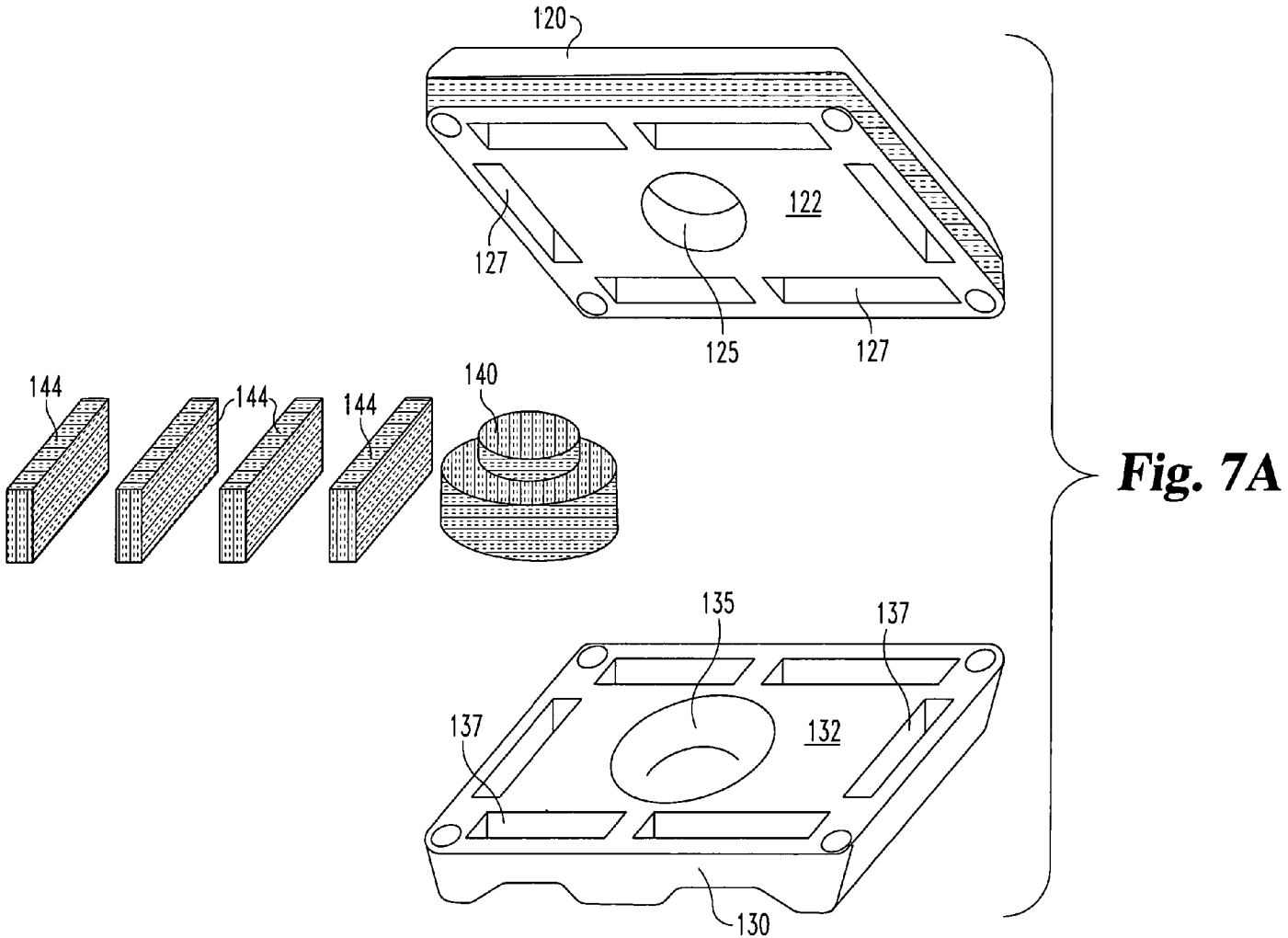
FIG. 7A is an exploded view of an alternate preferred embodiment of the present invention.

Illustrated in FIG. 7A is an alternate preferred embodiment of an exercise system 100 according to an alternate preferred embodiment of the present invention. System 100 includes platform 120, one or more risers 130 and one or more resilient members 140 and 144. Platform 120 includes sides and a top surface substantially similar in function to those of riser 20 and includes lower surface 122. Lower surface 122 includes recesses 125 and 127 of differing cross-sectional areas to receive portions of alternate resilient members 140 and 144. Riser 130 is formed substantially similar to riser 30 with upper surface 132 having recesses 135 and 137 in a pattern substantially similar to and opposite of the recesses in lower surface 122 of platform 120.

Figure 7B:
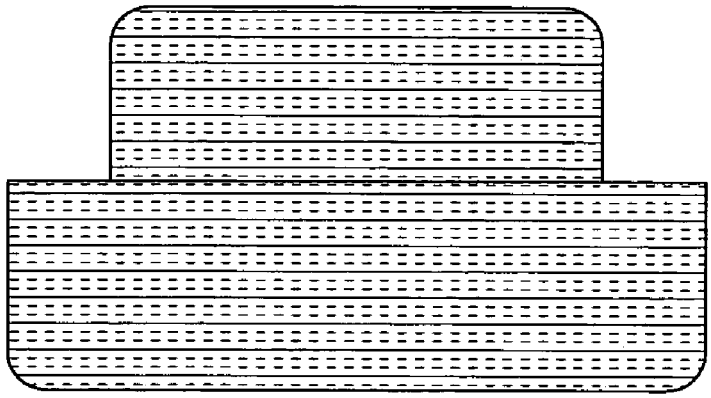
FIG. 7B is a side view of one resilient member useable in the embodiment in FIG. 7A.

Resilient member 140 is shown in a side view in FIG. 7B and preferably includes an upper cylindrical portion having a reduced diameter and a lower portion having a relatively larger diameter along a vertical axis. In a preferred embodiment, the smaller diameter portion is sized to be snugly received in recess 125 of platform 120, while the larger diameter portion is sized to be received in recess 135 of riser 130.

Figure 7C:
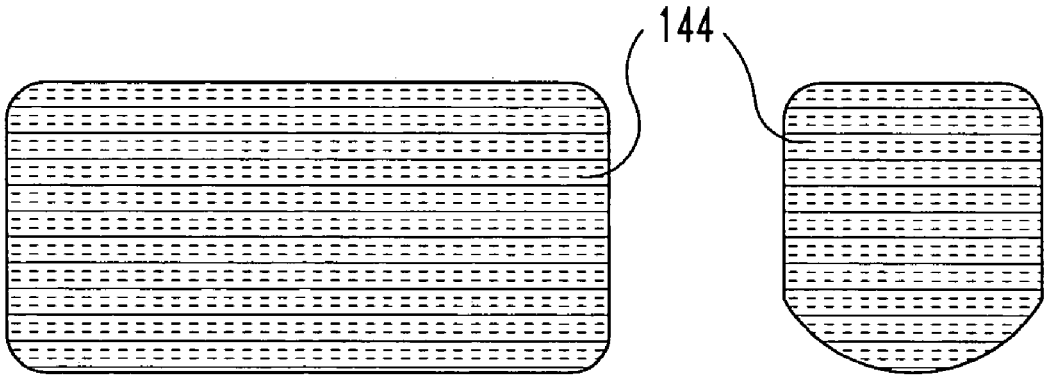
FIG. 7C is side and end views of a resilient member useable in the embodiment of FIG. 7A.

Alternate resilient member 144, pictured in side and end profiles in FIG. 7C, preferably has a rectangular cross-section along the vertical axis. In one embodiment, resilient member 144 includes a curved profile along the lower edge. Preferably the cross-sectional area of resilient member 144 is sized to be snugly received in recesses 127 of platform 120 and in opposing recesses 137 of riser 130. Preferably resilient members 140 and 144 have sufficient height to space platform 120 apart from riser 130 or a supporting surface when uncompressed.

Figure 8A:
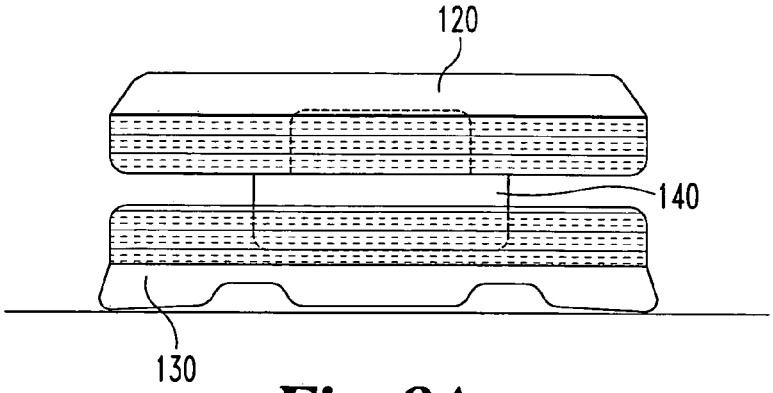
FIGS. 8A–8C illustrate one arrangement of a platform, riser section and an arrangement of resilient members according to one preferred embodiment of the present invention.
Figure 8B:
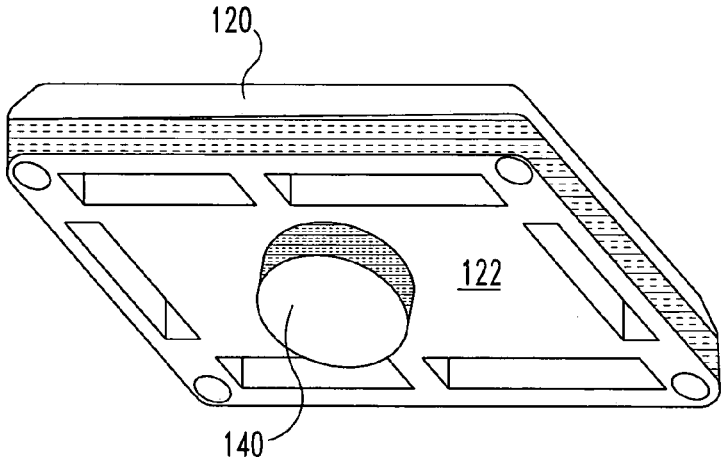
Figure 8C:
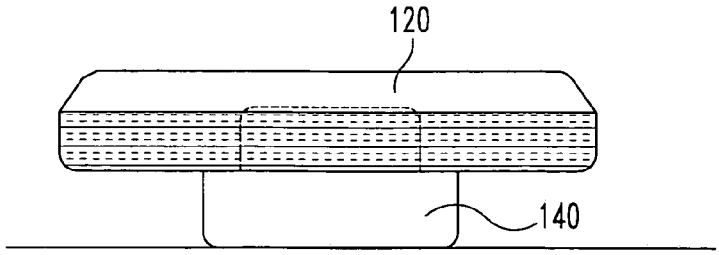
Figure 9A:
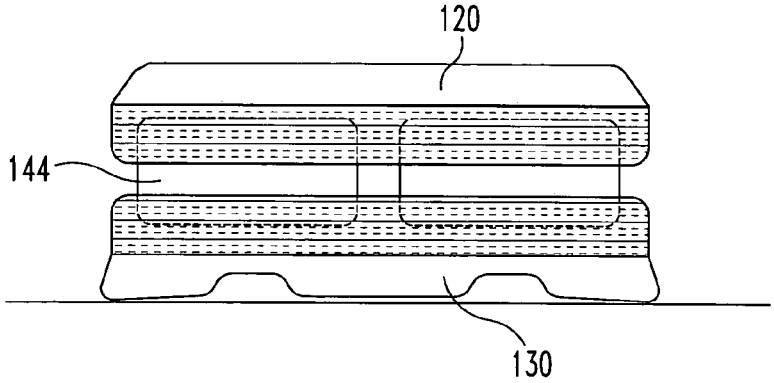
FIGS. 9A–9C illustrate an alternate arrangement of a platform, riser section and an arrangement of resilient members according to one preferred embodiment of the present invention.
Figure 9B:
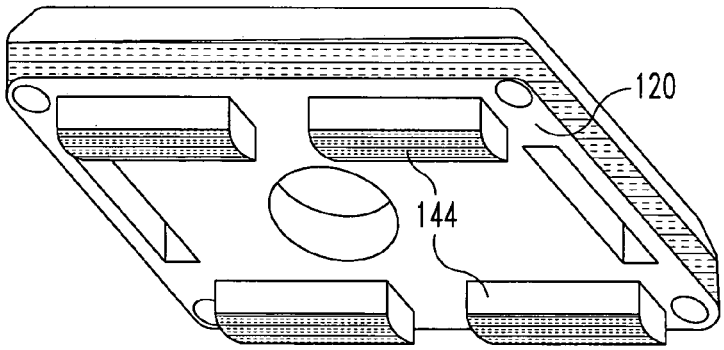
Figure 9C:
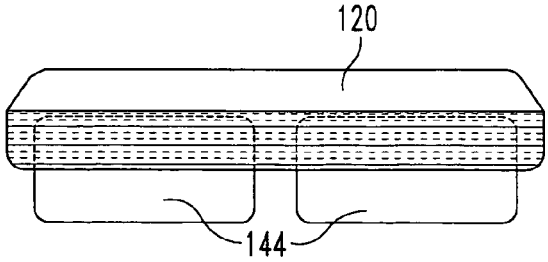

FIGS. 8A–8C illustrate one arrangement of system 100 with resilient member 144 centrally mounted to support platform 120 above riser 130 or a support surface. FIGS. 9A–9C illustrate system 100 with one arrangement of resilient members 144 to support platform 120 above riser 130 or a support surface.

Figure 10A:
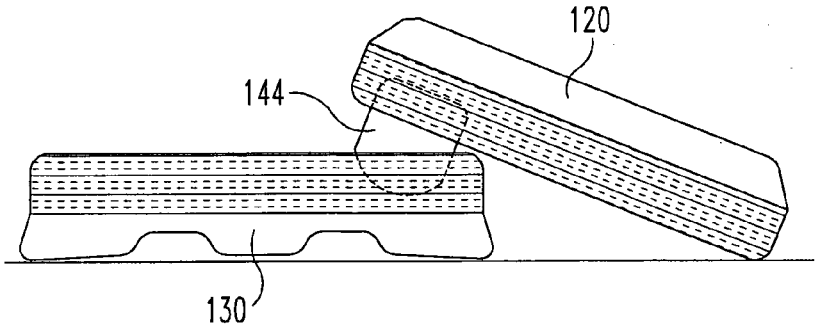
FIGS. 10A–10C illustrate a further alternate arrangement of a platform, riser section and an arrangement of resilient members according to one preferred embodiment of the present invention.
Figure 10B:
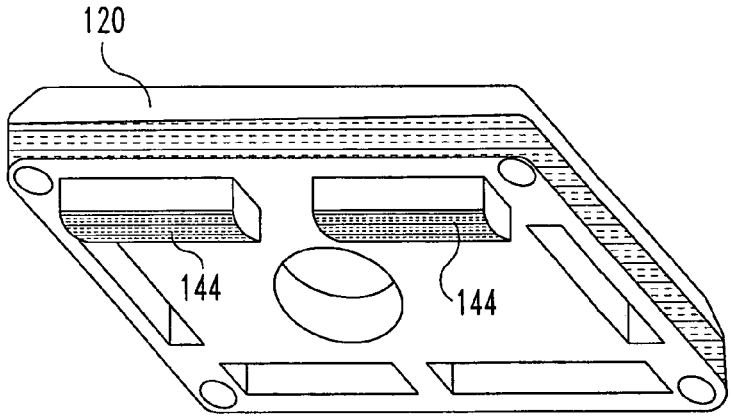
Figure 10C:
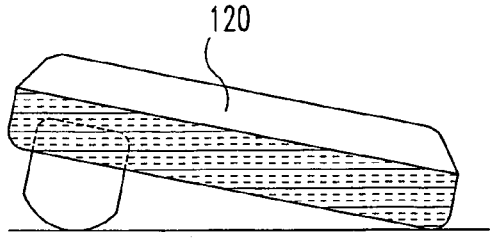
Figure 11A:
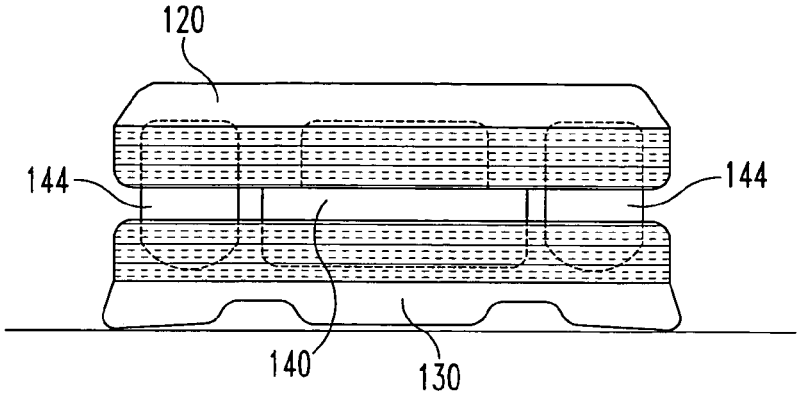
FIGS. 11A–11C illustrate a further alternate arrangement of a platform, riser section and an arrangement of resilient members according to one preferred embodiment of the present invention.
Figure 11B:
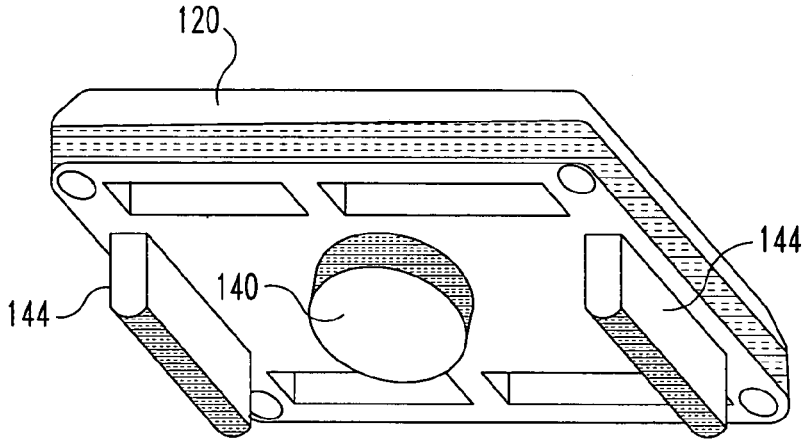
Figure 11C:
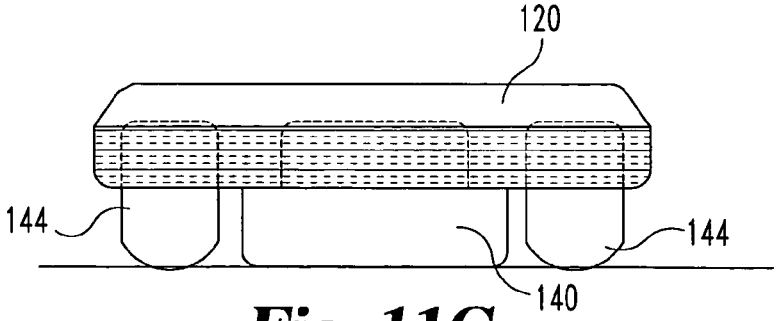
Figure 12A:
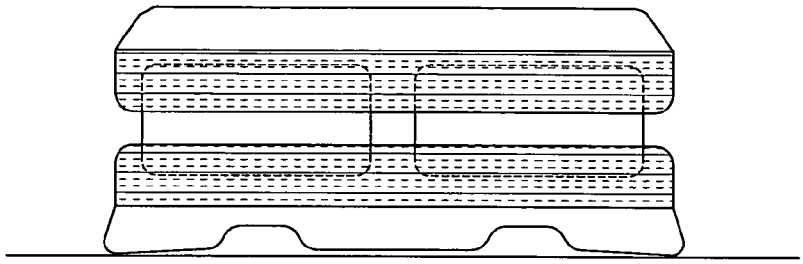
FIGS. 12A–12C illustrate a further alternate arrangement of a platform, riser section and an arrangement of resilient members according to one preferred embodiment of the present invention.
Figure 12B:
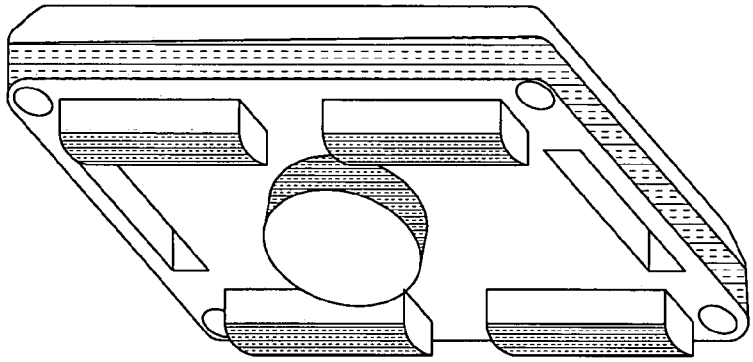
Figure 12C:
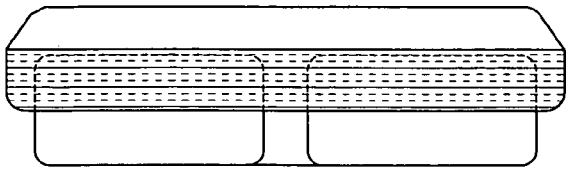

FIGS. 10A–10C illustrate an alternate preferred embodiment of system 100 including two resilient members 144 arranged to support platform 120 in a sloped configuration with respect to riser 130 or a support surface. FIGS. 11A–11C and 12A–C illustrate alternate preferred arrangements of resilient members 140 and 144 and system 100 supporting platform 120 in substantially horizontal and stable arrangements and with varying levels of compression and/or resistance.

Figure 13:
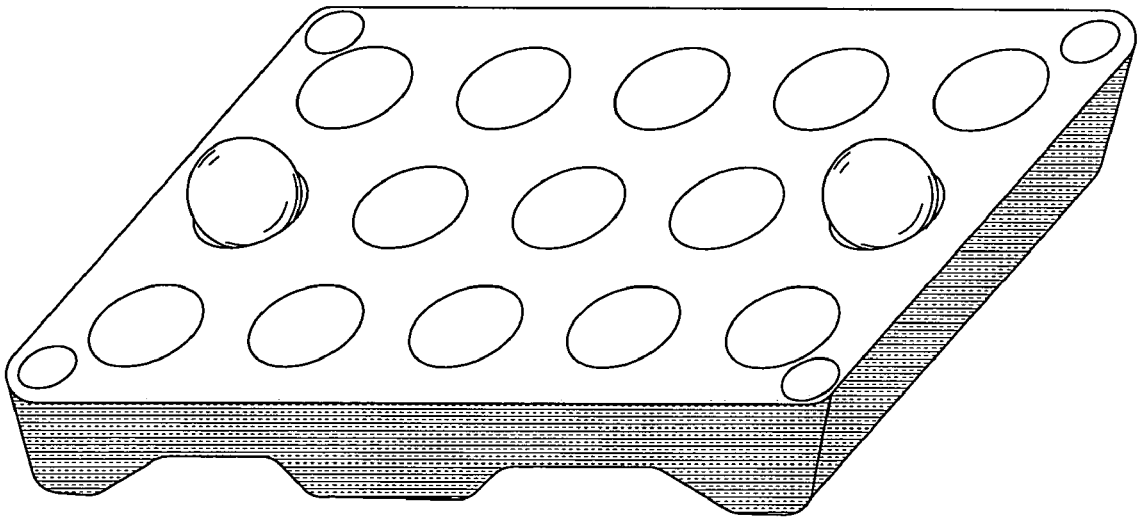
FIG. 13 illustrates a preferred embodiment of a riser and an arrangement of resilient members according to a further preferred embodiment of the present invention.

A still further exercise using the present system is illustrated FIG. 13. In this preferred embodiment, riser 30 is used on a support surface with one or more resilient members 40, without platform 20. This arrangement of the exercise system, offers users the ability to exercise the sole or arch of the foot over the top portions of resilient members 40, preferably from a seated position.

The present invention provides a multi-exercise machine which may be used for basic step or platform aerobics, for slanted surface aerobics or for other exercise regimens such as stretching, to improve balance or for yoga. Preferably the system is relatively compact for easy storage when not in use.

Preferably the materials for the platform and riser are durable to be used for multiple work-outs, such as plastic or wood. Accessories such as rubber feet, a non-slip coating or a traction decal may be applied as desired. In preferred embodiments, the system components include rounded corners and/or tapered sides to minimize sharp edges and/or for a decorative look. Optionally, handles or handle openings may be formed in the sides of the platform and risers.

In one option, various resilient materials, such as balls or rectangular cross-sectional pieces are provided in varying durometer levels or hardnesses so a user may select a desired level of compression when in use. Alternately, the resilient members may be designed in various heights to provide a higher or lower surface or more or less distance for compression.

When the system is used, the compression materials absorb shock and vibration when a user impacts the platform with a shoe or foot, such that the resilient material dampens and absorbs the transmitted force and minimizes the force transmitted to the ankles, knees, joints or body of the person. The present system may also be used with alternate exercises, such as to train someone to maintain their balance or to provide a slanted surface for a person to raise and lower their body over their toes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An exercise platform system, comprising:

(a) a platform having a top surface for a user to step upon and a lower surface, said platform top surface defining a plane;

(b) a riser having an upper surface opposing said lower surface of said platform, said riser upper surface defining a plane;

(c) at least one spherical resilient member;

(d) wherein said lower surface of said platform defines at least one recess for receiving a portion of said at least one resilient member and said upper surface of said riser defines at least one recess for receiving a portion of said at least one spherical resilient member; and, (e) wherein said platform, said riser and said at least one resilient member are combinable to form a plurality of exercise platform configurations with said at least one resilient member disposed between said lower surface of said platform and said upper surface of said riser and spacing said platform apart from said riser, said plurality of configurations including:

(f) a first configuration wherein said platform top surface plane and said riser upper surface plane are substantially parallel, and, (g) a second configuration wherein said platform top surface plane and said riser upper surface plane are substantially non-parallel wherein said recess in said upper surface of said riser and said recess in said lower surface of said platform are each sized substantially equal to each respective portion.

2. The exercise system of claim 1, comprising one or more retaining members for retaining said at least one resilient member in said at least one recess.

3. The exercise system of claim 1, wherein said upper surface of said riser defines at least one recess for receiving at least a portion of said at least one resilient member, and wherein said recess in said upper surface of said riser and said recess in said lower surface of said platform are each sized substantially equal to each respective portion.

4. An exercise platform system, comprising:

(a) a platform having a top surface for a user to step upon and a lower surface, said platform top surface defining a plane;

(b) a riser having an upper surface opposing said lower surface of said platform, said riser upper surface defining a plane;

(c) at least one spherical resilient member disposed between said lower surface of said platform and said upper surface of said riser and spacing said platform apart from said riser; and, (d) a plurality of resilient members disposed between said lower surface of said platform and said upper surface of said riser;

(e) wherein said platform, said riser, said at least one spherical resilient member and said plurality of resilient members are combinable to form a plurality of exercise platform configurations, said plurality of configurations including:

(f) a first configuration wherein said platform plane and said riser plane are substantially parallel, and, (g) a second configuration wherein said platform plane and said riser plane are substantially non-parallel wherein said upper surface of said riser defines a plurality of recesses for receiving at least a portion of said resilient members, said lower surface of said platform defines a plurality of recesses for receiving at least a portion of the resilient members and said recesses in said upper surface of said riser and said recesses in said lower surface of said platform are each sized substantially equal to each respective portion of the resilient members.

5. The exercise system of claim 4, wherein said resilient members are spherical and wherein said recesses in said platform and said riser are substantially hemispherical and sized to receive portions of said resilient members.

6. An exercise platform system, comprising:

(a) a platform having a top surface for a user to step upon and a lower surface;

(b) a riser having an upper surface opposing said lower surface of said platform;

(c) wherein said lower surface of said platform and said upper surface of said riser define a plurality of recessed locations; and, (d) one or more resilient members;

(e) wherein said platform, said riser and said one or more resilient members are combinable to provide a plurality of exercise platform configurations, said plurality of configurations providing selectively adjustable resilience for a user stepping on said platform and including:

(f) a first configuration wherein a first number of said one or more resilient members are arranged to support said lower surface of said platform above said upper surface of said riser such that one side of each resilient member is in contact with the platform and a respective opposite side of each said resilient member is in contact with the riser; and, (g) a second configuration wherein a second number of said one or more resilient members support said lower surface of said platform above said upper surface of said riser such that one side of each resilient member is in contact with the platform and a respective opposite side of each said resilient member is in contact with the riser and wherein the second number is different from said first number.

7. The exercise system of claim 6, wherein at least one of said plurality of recessed locations has a circular cross-section.

8. The exercise system of claim 7, wherein said plurality of recessed locations are substantially hemispherical and sized to receive portions of said resilient members.

9. The exercise system of claim 6, comprising one or more retaining members for retaining said one or more resilient members in said plurality of recessed locations.

10. The exercise system of claim 1, wherein said plurality of configurations further includes a third configuration with a plurality of resilient members disposed between said platform lower surface and said riser upper surface, wherein said plurality of resilient members are substantially arranged in an X-pattern.

11. The exercise system of claim 4, wherein said plurality of configurations further includes a third configuration with a plurality of resilient members substantially arranged in a plus-shape.

12. The exercise system of claim 6, wherein said plurality of configurations further includes a third configuration with a plurality of resilient members disposed between said lower surface of said platform and said upper surface of said riser substantially in an X-pattern.

13. The exercise system of claim 6, wherein said first number equals the number of said recessed locations in said platform and said second number is less than the number of said recessed locations in said platform.

* * * * *